US006770804B2

(12) United States Patent
Schleske

(10) Patent No.: US 6,770,804 B2
(45) Date of Patent: Aug. 3, 2004

(54) SOUNDBOARD OF COMPOSITE FIBER MATERIAL CONSTRUCTION

(76) Inventor: Martin Schleske, Seitzstrasse 4, Munchen (DE), 80538

( * ) Notice: Subject to any disclaimer, the term of this patent is extended or adjusted under 35 U.S.C. 154(b) by 0 days.

(21) Appl. No.: 09/935,975

(22) Filed: Aug. 23, 2001

(65) Prior Publication Data

US 2002/0066354 A1 Jun. 6, 2002

(30) Foreign Application Priority Data

Aug. 23, 2000 (DE) ..... 100 41 357

(51) Int. Cl.[7] ..... G10D 3/00

(52) U.S. Cl. ..... 84/290; 81/311; 81/267; 81/275

(58) Field of Search ..... 84/311, 290, 291, 84/267, 275

(56) References Cited

U.S. PATENT DOCUMENTS 4,364,990 A * 12/1982 Haines ..... 428/218
4,969,381 A * 11/1990 Decker et al. ..... 84/291
5,171,926 A * 12/1992 Besnainou et al. ..... 84/275
5,333,527 A * 8/1994 Janes et al. ..... 84/291
5,469,769 A * 11/1995 Sawada et al. ..... 84/193
5,895,872 A 4/1999 Chase
5,905,219 A 5/1999 Westheimer

FOREIGN PATENT DOCUMENTS

DE 37 38 459 A1 5/1989
EP 0433 430 B1 2/1995

* cited by examiner

*Primary Examiner*—Kimberly Lockett
(74) *Attorney, Agent, or Firm*—John K. McCulloch

(57) ABSTRACT

The invention presents a soundboard for acoustic musical instruments. Its use is possible for all acoustic musical instruments in which the sound radiation takes place by means of soundboards or resonant bodies composed of soundboards (or resonant back plates), preferably for bowed stringed instruments. The soundboard according to the invention is produced as a composite fiber sandwich. The core plate of the sandwich construction is provided with at least one recess. The soundboard according to the invention makes possible an increased sound radiation by comparison with the conventional soundboards made from solid wood or composite.

10 Claims, 2 Drawing Sheets

SOUNDBOARD OF COMPOSITE FIBER MATERIAL CONSTRUCTION

Figure 1A:
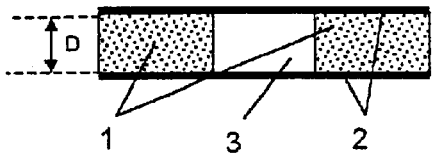

The invention relates to a soundboard of composite fibre material construction comprising at least one composite fibre laminate consisting of long fibres and carrier material, such soundboard being for use in an acoustic musical instrument, particularly a bowed stringed instrument.

However, the invention can also be used for other acoustic musical instruments (such as guitars and pianos) which are provided with a resonant body or resonant back-plate.

BACKGROUND OF THE INVENTION

In recent years attempts have also been made to produce the soundboards of acoustic musical instruments in composite fibre material construction. Structures of composite fibre material construction generally consist of elongate fibres which are preferably oriented in certain directions and a carrier or matrix material which is generally a thermosetting or thermoplastic plastics material. In the preferred embodiment of the invention this is an epoxy resin system.

The previous efforts to produce soundboards of composite fibre material construction intended for acoustic musical instruments are aimed without exception at copying as well as possible the acoustic characteristics of the wood which is to be substituted. Examples of these attempts in the previously known prior art are provided for instance by DE 37 38 459 A1, EP 0 433 430 B1, U.S. Pat. No. 5,895,872 and U.S. Pat. No. 5,905,219. Thus DE 37 38 459 A1 aims at "a macroscopic heterogeneity almost equal to the wood" and states as the object that "the composite material" should "have similar characteristics to spruce".

An unsatisfactory feature of these previously known soundboards of composite fibre material construction appears to be that from the acoustic point of view they are equivalent but in no way superior to very good solid wood soundboards of traditional construction.

The object of the invention, therefore, is to create a soundboard of composite fibre material construction which has a perceptibly better acoustic quality by comparison with excellent soundboards of traditional construction. In particular the soundboard according to the invention should have substantially higher radiated power whilst retaining the usual and desirable timbre of a solid wood soundboard.

SUMMARY OF THE INVENTION

This object is achieved according to the invention in that the core plate has at least one recess surrounded by material zones of the core plate within the area defined by the outline of the soundboard, the total volume of all recesses amounting at most to 80%, preferably between 20 and 45%, of the total volume of the core plate filled with material.

Composite fibre sandwich structures are basically constructed in such a way that a core plate of low density is provided on both sides with composite fibre laminate layers. In this case the bending strength of the structure is heavily dependent upon the thickness of the core plate. Core plates of composite fibre sandwich constructions are frequently produced from hard foam materials. Balsa wood is used for the preferred embodiment of the invention. The fibre laminate can be produced by means of layered fibre structures, fibre meshes, hand lay-up laminated individual rovings or the like, as prepreg or by means of a suitable manufacturing process. Layered fibre structures in the form of prepregs are preferably used in the construction according to the invention. These are preferably single-layer and at the same time multidirectional.

In detail, the invention is based upon the following considerations and tests:

The vibration levels of the characteristic vibrations are crucial for the sound radiation of the instrument. They are dependent upon the vibrating mass of the soundboard. The vibration resistance (so-called impedance) which the soundboard opposes to the exciting alternating force generated by the string vibrations is greater the higher the vibrating mass of the soundboard is. In order to achieve high vibrating speeds (so-called velocity) of the soundboard and thus the most effective possible sound radiation of the instrument, with a given excitation force the lowest possible vibration resistance and thus the lowest possible vibrating mass are necessary.

For these reasons it is sensible to reduce the vibrating mass of the soundboard of composite fibre material construction.

It might be thought that the required reduction of the vibrating mass could be achieved by reducing the thickness of the core plate. This possibility has proved unfavourable in so far as a reduction in the thickness of the core plate is accompanied by a reduction in the quotient of bending strength and total density. The bending strength should be high in order to achieve large-area in phase antinodes of the characteristic vibrations of the soundboard and to shift downwards the so-called cutoff frequency [Cremer, L., Heckl, M.: "Körperschall", Berlin 1996, page 498], below which no effective sound radiation is possible any longer, and to avoid hydrodynamic short circuits [loc. cit. page 477].

A further possibility for reducing the vibrating mass of the soundboard would be to reduce the area or the weight per unit area of the fibre laminate. Here too there is a danger of a reduction in the quotient of bending strength and total density.

A third possibility for reducing the vibrating mass of the soundboard could be seen in the reduction of the board dimensions. However, this would have the disadvantage that the characteristic frequencies would be shifted upwards and as a result the timbres of the instrument would be changed in an undesirable manner.

With these considerations as a starting point, therefore, the invention follows a fundamentally different route in order to reduce the vibrating mass of the soundboard of composite fibre material construction: Recesses are provided in the core plate.

The vibrating mass of the soundboard which is reduced according to the invention enables instruments to be produced with an improved acoustic efficiency relative to the prior art.

Some embodiments of the invention are explained in greater detail below with reference to the drawings.

THE DRAWINGS

Figure 1B:
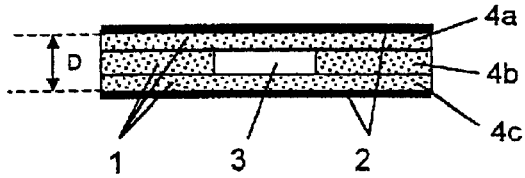
Figure 1C:
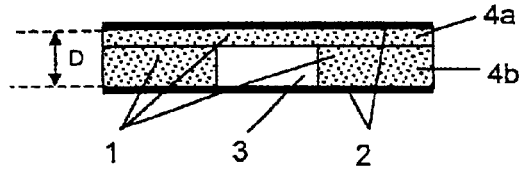
Figure 1D:
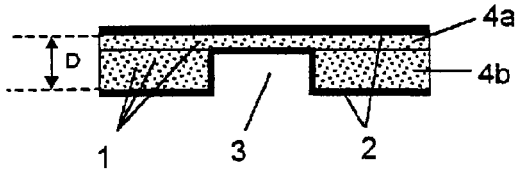
Figure 1E:
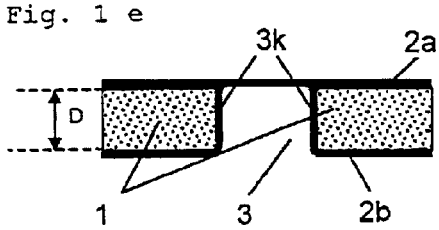
Figure 1F:
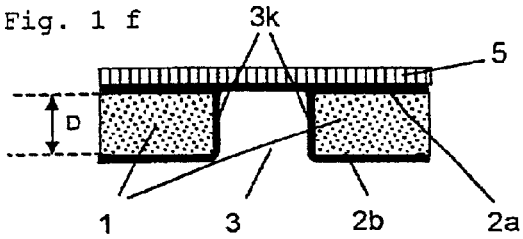
Figure 1G:
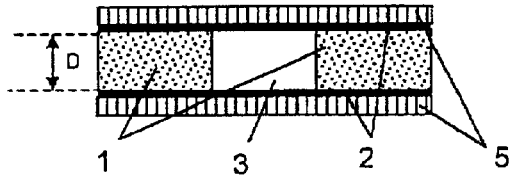

FIGS. 1*a* to 1*i* each show a cross-section through a small segment of the area of various embodiments of the soundboard according to the invention. FIG. 2 shows an embodiment of the soundboard according to the invention using the example of a bowed stringed instrument. Finally, in FIG. 3 the perspective detail view of a surface element of the soundboard according to the invention can be seen.

DETAILED DESCRIPTION

According to the invention the core plate 1 has recesses 3 in the core plate material in at least one zone, but preferably in a plurality of zones at which the soundboard in the installed state is subjected to low bending stresses. These zones preferably lie in regions of strong antinodes of the soundboard, since there a reduction in the vibrating mass has a particularly positive effect in the sense of increasing the vibrating speed (velocity) and thus the sound radiation. In some areas of minimal static load the core plate recess 3 extends through the entire thickness of the core plate, as is shown in the embodiments in FIGS. 1*a*, 1*e* to 1*i*. As a result the fibre laminate 2 acts in these areas—apart from the desired mass reduction—in a similar manner, regarded dynamically, to a vibrating membrane, the area of which corresponds to the area of the recess. In this case, as can be seen in FIGS. 1*e* and 1*f*, the lower fibre laminate 2*b* is preferably connected via the edges of the recess 3*k* to the upper fibre laminate 2*a*.

The fibre laminate 2 is preferably additionally coated with a thin layer 5, which can again preferably be a layer of solid wood. FIGS. 1*f* and 1*g* show these variants of FIGS. 1*e* and 1*a*. In addition to the visual benefits of this embodiment there is also the advantage that the solid wood layer 5 acts jointly with the fibre laminate 2 as a membrane in some variants, as shown in FIGS. 1*f*, 1*g* and 1*i*.

In those areas of the soundboard which are subjected to higher static stresses and in which therefore a reduction of the bending strength of the soundboard must be dispensed with, the core plate recesses 3 do not extend through the entire thickness D of the core plate but has a depth less than the core plate. This is shown in FIGS. 1*b* to 1*d*, and in this case the core plate is preferably made up of various layers 4. When the recess is positioned in the centre of the cross-section of the core plate 1 (FIG. 1*b*) the core plate 1 is made up of three layers 4*a* to 4*c*, and when the recess is positioned on one side of the cross-section (FIGS. 1*c* and 1*d*) the core plate is made up of two layers 4*a* and 4*b*.

Figure 1H:
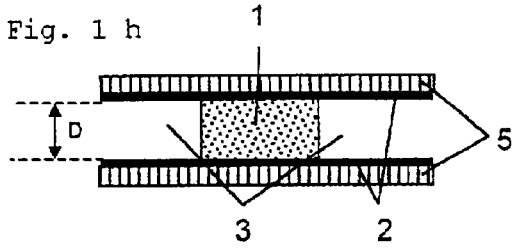
Figure 1I:
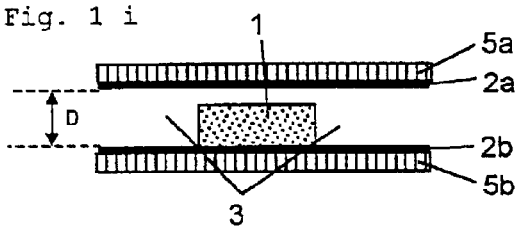
Figure 2:
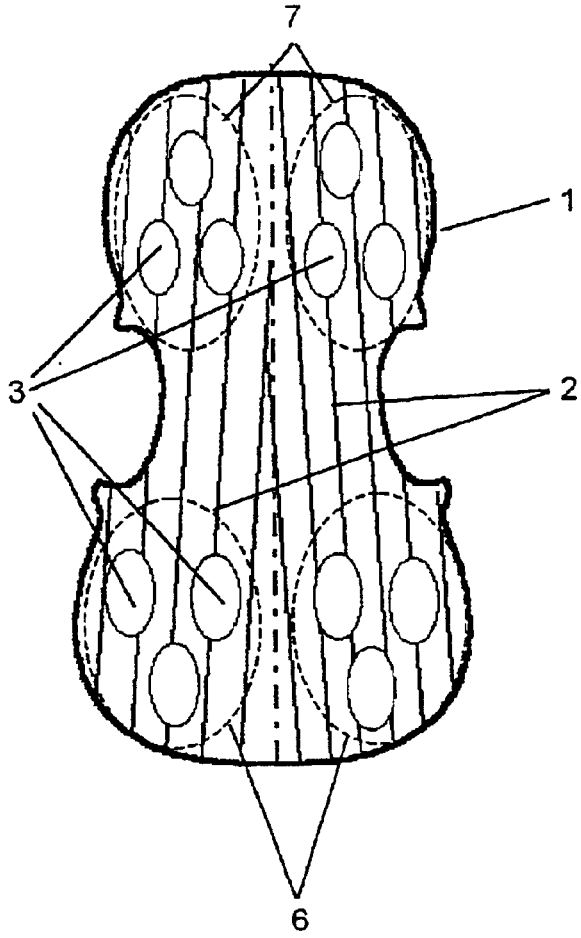

As shown in FIGS. 1*h* and 1*i*, in some localised areas—as an extreme case of the recess 3 of the soundboard according to the invention—it may be advantageous that the volume of the core plate recess 3 is greater than that of the remaining core plate material 1. Here the remaining core plate material functions virtually as an "inner reinforcement" of the structure. In individual cases this "inner reinforcement" can even be applied only on one face of the fibre laminate 2, as shown in FIG. 1*i*. In the case of the embodiment shown in FIG. 1*i* the lower fibre laminate 2*b* and the solid wood layer 5*b* is stiffened by the "inner reinforcement", whilst the upper fibre laminate 2*a* with the solid wood layer 5*a* can vibrate more strongly like a membrane, as described above.

These extreme cases (of a recess volume which is greater than the volume of the core material) which are illustrated in FIGS. 1*h* and 1*i* are, however, preferably restricted to a few localised areas. Considered overall, the total volume of all recesses 3 amounting at most to 80%, preferably between 20 and 45% is markedly less than the total volume of the core plate filled with material (At 100% the total volume of al recesses would be identical to the total volume of the remaining core material).

For decoupling of the soundboard, for instance in the region of the edge, it is advantageous to reduce the thickness of the core plate. Therefore the core plate preferably has a localised difference in thickness.

FIG. 2 shows the zones of some recesses 3 within the core plate 1 using the example of the soundboard according to the invention for a violin. In the case of bowed stringed instruments the regions referred to above of high vibration level and low static stresses lie above all within the two lower cheeks 6 and upper cheeks 7. The zones of the core plate recesses 3 (three per cheek in the illustrated example, that is to say a total of twelve) are therefore preferably positioned within these four regions. Depending upon the type of acoustic musical instrument for which the soundboard according to the invention is used (above all a bowed stringed instrument, guitar or piano), these regions provided with core plate recesses 3 occupy different positions within the soundboard. The most favourable positions are preferably determined using a modal analysis. This gives information concerning the distribution of the vibration amplitudes of the soundboard. (The fibre laminate of the core plate is merely symbolised in FIG. 2 by the lines 2. The actual embodiment naturally has a substantially denser and thin-fibre fibre laminate than that symbolised in FIG. 2).

Figure 3:
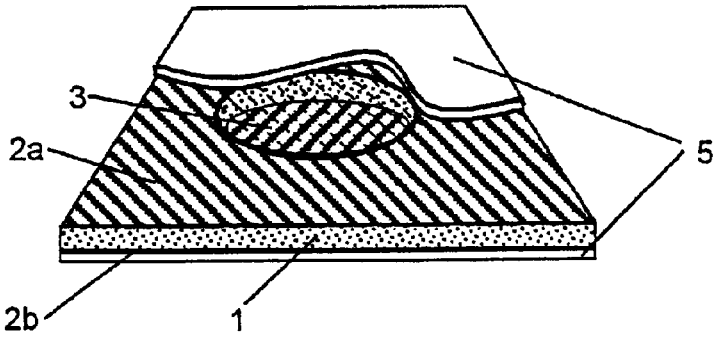

FIG. 3 shows a small segment of area of the preferred embodiment of the soundboard according to the invention which corresponds to the cross-section through the soundboard shown in FIG. 1*g*. The core recess 3 in this case is covered over on both faces of the core plate 1 not only by the fibre laminate 2 (i.e. on the upper face by the upper fibre laminate 2, on the lower face by the lower fibre laminate 2*b*) but also by the solid wood layer 5.

What is claimed is:

1. A soundboard for use in an acoustic musical instrument, said soundboard comprising a low density core plate having two opposite faces, and a fibre laminate overlying and adhered at least to one of said faces, said fibre laminate having elongate fibres embedded in a carrier, said core plate having at least one recess wholly within the confines of said core plate, the total volume of all recesses in said core plate amounting to not more than about 80% of the total volume of said core plate.

2. The soundboard according to claim 1 wherein the total volume of recesses in said core plate amounts to between about 20% and 45% of the total volume of said core plate.

3. The soundboard according to claim 1 wherein said at least one recess in said core plate extends through the entire thickness of said core plate.

4. The soundboard according to claim 1 wherein at least one recess in said core plate has a depth less than the thickness of said core plate.

5. The soundboard according to claim 1 wherein said core plate is composed of multiple layers of material overlying one another and wherein said at least one recess extends through fewer than all of said layers.

6. The soundboard according to claim 1 wherein selected areas of said core plate have different thicknesses.

7. The soundboard according to claim 1 wherein said fibre laminate is a single layer and the fibres embedded therein extended in multiple directions.

8. The soundboard according to claim 1 including a second said fibre laminate overlying and adhered to the other of said faces of said core plate.

9. The soundboard according to claim 8 including a solid layer of material overlying the exterior of each said fibre laminate.

10. The soundboard according to claim 1 including a solid layer of material overlying the exterior of said at least one fibre laminate.

* * * * *